US007970332B2

(12) United States Patent
Law et al.

(10) Patent No.: US 7,970,332 B2
(45) Date of Patent: Jun. 28, 2011

(54) OIL LESS FUSING USING NANO/MICRO TEXTURED FUSING SURFACES

(75) Inventors: Kock-Yee Law, Penfield, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 282 days.

(21) Appl. No.: 12/164,500

(22) Filed: Jun. 30, 2008

(65) Prior Publication Data

US 2009/0324308 A1 Dec. 31, 2009

(51) Int. Cl.
*G03G 15/20* (2006.01)

(52) U.S. Cl. ..... 399/333

(58) Field of Classification Search ..... 399/329, 399/330, 331, 332, 333; 219/216; 430/124.32, 430/124.33, 124.35
See application file for complete search history.

(56) References Cited

U.S. PATENT DOCUMENTS

| | | | | |
|---|---|---|---|---|
| 5,127,325 | A * | 7/1992 | Fadner | 101/348 |
| 5,187,849 | A * | 2/1993 | Kobayashi | 492/59 |
| 5,629,761 | A * | 5/1997 | Theodoulou et al. | 399/307 |
| 5,640,662 | A * | 6/1997 | Sugimoto et al. | 399/333 |
| 5,753,348 | A | 5/1998 | Hatakeyama et al. | |
| 6,215,965 | B1 * | 4/2001 | Sato | 399/16 |
| 6,377,777 | B1 * | 4/2002 | Kishino et al. | 399/329 |
| 6,668,152 | B1 * | 12/2003 | Jacob | 399/333 |
| 6,731,902 | B2 * | 5/2004 | Takenaka et al. | 399/333 |
| 6,961,533 | B2 * | 11/2005 | Sano et al. | 399/330 |
| 7,515,858 | B2 * | 4/2009 | Tamemasa | 399/333 |
| 2007/0048046 | A1 | 3/2007 | Tamemasa | |
| 2008/0306202 | A1 * | 12/2008 | Lin et al. | 524/432 |
| 2009/0041516 | A1 * | 2/2009 | Fukaya | 399/333 |
| 2009/0123185 | A1 * | 5/2009 | Lin et al. | 399/176 |

FOREIGN PATENT DOCUMENTS

| | | | |
|---|---|---|---|
| DE | 102005001350 | A1 * | 7/2006 |
| JP | 09106209 | A * | 4/1997 |
| JP | 2002038094 | A * | 2/2002 |
| JP | 2005091921 | A * | 4/2005 |

OTHER PUBLICATIONS

European Patent Office, European Search Report, European Patent Application No. 09162651.5, Dec. 1, 2010, 9 Pages.

* cited by examiner

*Primary Examiner* — Robert Beatty
(74) *Attorney, Agent, or Firm* — MH2 Technology Law Group LLP

(57) ABSTRACT

Exemplary embodiments provide a fixing member having a textured surface, and methods for making and using the textured fixing member. The fixing member can include a substrate having one or more functional layers formed thereon. The one or more functional layers can include an outermost or top surface having a surface wettability that is hydrophobic and/or oleophobic; ultrahydrophobic and/or ultraoleophobic; or superhydrophobic and/or superoleophobic by forming textured features. Such fixing member can be used as an oil-less fusing member for high speed, high quality electrophotographic printing to ensure and maintain a good toner release from the fused toner image on an image supporting material (e.g., a paper sheet), and further assist paper stripping. In addition, the textured surface can provide an oil-free, such as wax-free, toner design for the oil-less fixing process.

20 Claims, 5 Drawing Sheets

OIL LESS FUSING USING NANO/MICRO TEXTURED FUSING SURFACES

DESCRIPTION OF THE INVENTION

1. Field of the Invention

This invention relates generally to fixing members and operations of an electrophotographic printing process and, more particularly, to oil-less fusing members and operations using textured surfaces.

2. Background of the Invention

In the electrophotographic printing process, a toner image can be fixed or fused upon a support (e.g., a paper sheet) using a fuser roll. Conventional fusing technologies apply release agents/fuser oils to the fuser roll during the fusing operation, in order to maintain good release properties of the fuser roll. For example, oil fusing technologies have been used for all high speed products in the entry production and production color market.

Unlike conventional oil fusing technologies, oil-less fusing technologies remove the oil application step from the fusing operation and have been used for color printers and multi functional copier-printers in the small office and home office market. However, conventional oil-less fusing technologies have not been used for all high speed products. For example, there remain technical challenges for oil-less fusing at speeds higher than 70 ppm, while meeting a series of stringent system requirements such as image quality, parts cost, reliability, long component life, etc.

In addition, in oil less fusing, waxy toner is often used to aid release of the toner image. Consequently, however, wax can be transferred to the fuser surface (e.g., a PTFE surface) and thus contaminate the fuser surface when using the conventional PTFE surface. For example, one frequently mentioned failure mode for PTFE oil less fuser is called wax ghosting. The wax on the PTFE affects the image quality of the next print.

Thus, there is a need to overcome these and other problems of the prior art and to provide an oil-less fusing technology to high speed electrophotographic printing systems and also to improve toner designs.

SUMMARY OF THE INVENTION

According to various embodiments, the present teachings include a fixing member that includes a substrate, and one or more functional layers formed on the substrate. The one or more functional layers can include a textured outermost surface for providing a surface wettability suitable for an oil-less fixing.

According to various embodiments, the present teachings also include a method for making a fixing member. In this method, a substrate can be provided followed by forming one or more functional layers on the substrate. The one or more functional layers can be formed including a textured outermost surface for providing a surface wettability suitable for an oil-less fixing upon an image supporting material.

According to various embodiments, the present teachings further include a method for fixing an toner image by first providing a fusible toner image on an image supporting material. A fixing member can then be formed including a textured outermost surface having a surface wettability for an oil-less toner fixing upon the image supporting material. The formed fixing member can then be applied onto the fusible toner image on the image supporting material and whereby forming a fuser nip with a second fixing member. The second fixing member can include a pressure applying mechanism. The fuser nip can be heated to fix the toner image on the image supporting material.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1A:
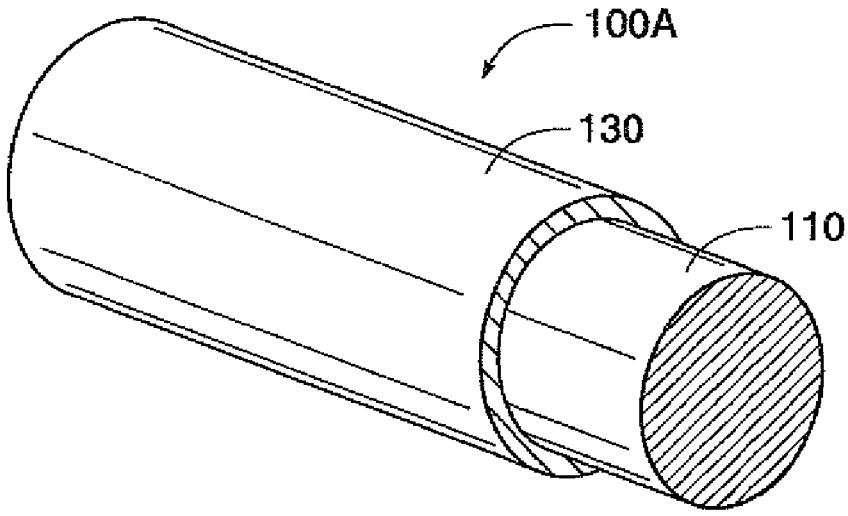
FIGS. 1A-1B depict exemplary fixing members having a cylindrical substrate in accordance with the present teachings.

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Exemplary embodiments provide a fixing member having a textured surface, and methods for making and using the textured fixing member. The fixing member can include a substrate having one or more functional layers formed thereon. The substrate can include, e.g., a cylinder or a belt. The one or more functional layers can include an outermost or top surface having a surface wettability that is hydrophobic and/or oleophobic; ultrahydrophobic and/or ultraoleophobic; or superhydrophobic and/or superoleophobic by forming textured features in a nano-, micro-and/or nano-micro-scale. Such fixing member can be used as an oil-less fusing member for high speed, high quality electrophotographic printing to ensure and maintain a good toner release from the fused toner image on an image supporting material(erg., a paper sheet), and further assist paper stripping. In another embodiment, the textured surface can provide an oil-free, such as wax-free, toner design for the oil-less fixing process.

As used herein the term "textured surface" or "surface texture" refers to a surface having one or more surface structures/features that provide a desired surface wettability including, for example, hydrophobicity and/or oleophobicity; ultrahydrophobicity and/or ultraoleophobicity; as well as superhydrophobicity and/or superoleophobicity.

As used herein, the term "hydrophobic/hydrophobicity" and the term "oleophobic oleophobicity" refer to the wettability behavior of a surface that has, e.g., a water and hexadecane (or hydrocarbons, silicone oils, etc.) contact angle of approximately 90° or more, respectively. For example, on a hydrophobic/oleophobic surface, a ~10-15 μL water/hexadecane drop can bead up and have an equilibrium contact angle of approximately 90° or greater.

As used herein, the term "ultrahydrophobicity/ultrahydrophobic surface" and the term "ultraoleophobic/ultraoleophobicity" refer to wettability of a surface that has a more restrictive type of hydrophobicity and oleophobicity, respectively. For example, the ultrahydrophobic/ultraoleophobic surface can have a water/hexadecane contact angle of about 120° or greater.

In addition, the term "superhydrophobicity/superhydrophobic surface" and the term "superoleophobic/superoleophobicity" refer to wettability of a surface that has a even more restrictive type of hydrophobicity and oleophobicity, respectively. For example, a superhydrophobic/superoleophobic surface can have a water/hexadecane contact angle of approximately 150 degrees or greater and can have a ~10-15 μL water/hexadecane drop tend to roll freely on the surface tilted a few degrees from level. The sliding angle of the water/hexadecane drop on a superhydrophobic/superoleophobic surface can be about 10 degrees or less. On a tilted superhydrophobic/superoleophobic surface, since the contact angle of the receding surface is high and since the interface tendency of the uphill side of the drop to stick to the solid surface is low, gravity can overcome the resistance of the drop to slide on the surface. A superhydrophobic/superoleophobic surface can be described as having a very low hysteresis between advancing and receding contact angles (e.g., 10 degrees or less). Note that larger drops can be more affected by gravity and can tend to slide easier, whereas smaller drops can tend to be more likely to remain stationary or in place.

In one embodiment, the textured surface can be a nano-or micro-structured surface having various regular or irregular topographies, such as periodical and/or ordered nano-, micro-, or nano-micro-surface structures. For example, the disclosed textured surface can have protrusive or intrusive features for providing desired surface wettability. In an exemplary embodiment, the textured surface can have protuberances, 80% of them at least, having heights ranging between 20 nm and 10 μm, mean diameters between 20 nm and 10 μm, 80% at least of the distances between two neighboring protuberances ranging between 20 nm and 10 μm. In an additional example, the surface features can have a height or depth ranging from about 0.2 micron to about 4 microns and a lateral dimension of about 0.1 micron to about 2 micron.

In various embodiments, the disclosed textured surface can prevent water/hexadecane from a completely touching. That is, the contact area of water/hexadecane to the surface (i.e., the solid-liquid interface area) can be reduced. The reduced contact surface area can result in a very low adhesion between the water/hexadecane and the textured surface. Assuming the contact surface area is about 100% when water/hexadecane completely touching the surface, a reduced contact surface area of the disclosed textured surface to water or hexadecane can be about 1% to about 50%.

In another embodiment, the textured features can have various cross-sectional shapes, such as, for example, square, rectangular, circle, star, or any other suitable shapes, which can provide desired surface wettability.

In various embodiments, the surface texture features can be random. For example, the random surface texture can have a roughness generated from a spontaneous process, such as freezing, deposition, precipitation, and/or self-aggregation. The size and shapes of the random surface texture can be arbitrary or irregular. For example, a polymeric superhydrophobic coating (e.g., polypropylene) can be formed using a suitable solvent (e.g., p-xylene) and suitable temperature (e.g., at about 130° C.) to control the surface roughness and thus control the hydrophobicity or superhydrophobicity of the resulting surface, for example, having a gel-like porous coating with a water contact angle of about 160° or higher. In an exemplary embodiment, the textured surface can have a roughness scale similar to that of a lotus leaf, which is superhydrophobic and has a water contact angle of about 170° or higher.

In various embodiments, the textured surface can have hierarchical surface texture having periodical structures on two or more scales. Examples can include fractal and self-affined surfaces that refers to a fractal one in which its lateral and vertical scaling behavior is not identical but is submitted to a scaling law. For example, the regular surfaces can include square pillars.

In various embodiments, the textured surface can be made of a variety of materials, for example, silicone rubbers; fluoroelastomers such as copolymers of vinylidenefluoride, hexafluoropropylene and tetrafluoroethylene, and terpolymers of vinylidenefluoride, hexafluoropropylene and tetrafluoroethylene; Fluoroplastics such as the Teflon class of materials available from E.I. DuPont de Nemours, Inc. including Teflon® PFA (polyfluoroalkoxypolytetrafluoroethylene), Teflon® PTFE (polytetrafluoroethylene), Teflon® FEP (fluorinated ethylenepropylene copolymer); fluoropolyimides or fluoropolyurethanes. In various embodiments, surface modifications (physical and/or chemical) can be applied on the textured surface to further enhance the surface wettability.

In various embodiments, the textured surface or the surface texture can be formed using, e.g., photolithography, e-beam lithography, soft lithography or other micro-machining techniques. In some cases, for example, in a less systematic way, oxygen etching or plasma etching can also be used. In an exemplary embodiment, the textured surface can be formed by a molding technique, such as a melt-extrusion or injection mold process used in plastic industry, through a mold that has rough surface structures that can be transferred (molded) onto the desired surface for providing desired surface wettability. One such technique can include, e.g., thermal embossing.

The textured surface having the desired wettability can be used as an outermost (or topmost) surface of a fixing member, for example, a fusing roller or a fusing belt, for an oil-less operation in the electrophotographic printing process.

In some embodiments, the textured surface can provide a hydrophobicity, for example, having a water contact angle of about 120° or greater. The textured surface can then be ultrahydrophobic and/or superhydrophobic. In other embodiments, the textured surface can provide an oleophobicity, e.g., having a hexadecane (or hydrocarbons, silicone oils, etc.) contact angle of about 90° or greater. The textured surface can then be ultraoleophobic and/or superoleophobic.

While not intending to be bound by any particular theory, it is believed that an oleophobic surface can also provide a hydrophobicity of the surface, though a hydrophobic surface does not necessarily provide an oleophobicity of the surface.

The disclosed hydrophobic/oleophobic textured surface can be used in oil-less fusing processes to assist toner release and paper stripping, as well as to improve toner design. For example, in the cases when waxy toner is involved in the toner design, a hydrophobic but oleophilic textured oil-less fuser surface can have the wax spread on the hydrophobic surface and thus can eliminate wax ghosting in the following prints. Still in the cases when waxy toner is involved in the toner design, an oleophobic textured oil-less fuser surface can prevent wax from transferring onto the surface and thus can eliminate wax ghosting and other contaminations. More importantly, when the oleophobic textured oil-less fuser is used, wax can be removed from the toner design due to the oleophobicity and hydrophobicty of the fuser surface.

Such oil less fusing can provide many more advantages. For example, the elimination of the entire oil delivering system in fuser can provide lower manufacture cost, lower operating cost (e.g., due to no oil-replenishment), simpler subsystem design and lighter weight. In addition, an oil-free fusing process/operation can overcome, e.g., non-uniform oiling of the fuser that generates print streaks and unacceptable image quality defect, and some machine reliability issue (e.g., frequent breakdown) that generates high service cost and customer dissatisfaction.

In various embodiments, the fixing member can include, for example, a substrate, with one or more functional layers formed thereon. The substrate can be formed in various shapes, e.g., a cylinder (e.g., a cylinder tube), a cylindrical, a belt, or a film, using suitable materials that are non-conductive or conductive depending on a specific configuration, for example, as shown in FIGS. 1A-1B and FIG. 2.

Figure 1B:
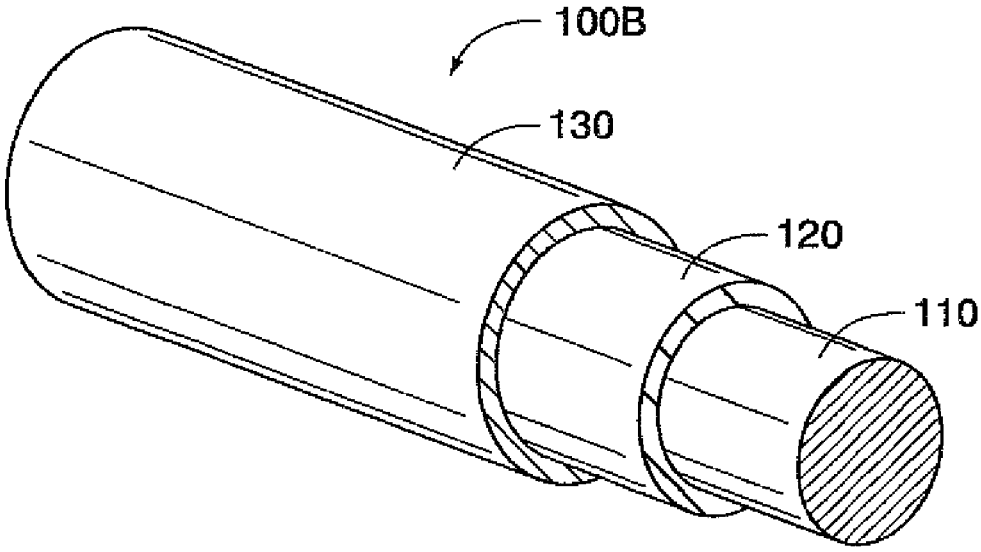
Figure 2:
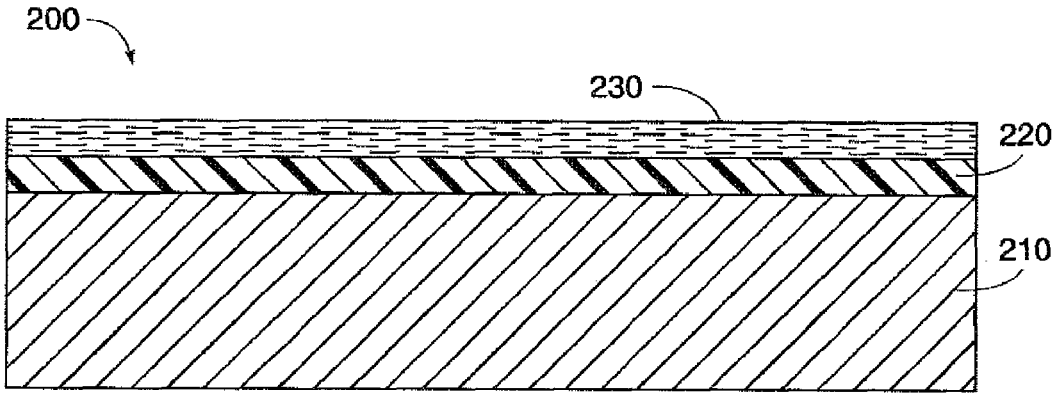
FIG. 2 depicts an exemplary fixing member having a belt substrate in accordance with the present teachings.

Specifically, FIGS. 1A-1B depict exemplary fixing members 100A-B having a cylindrical substrate 110 and FIG. 2 depicts another exemplary fixing member 200 having a belt substrate 210 in accordance with the present teachings. It should be readily apparent to one of ordinary skill in the art that the devices 100A-B depicted in FIGS. 1A-1B and the device 200 depicted in FIG. 2 represent generalized schematic illustrations and that other layers/substrates can be added or existing layers/substrates can be removed or modified.

In FIGS. 1A-1B, the exemplary fixing members 100 A-B can be fuser rollers having a cylindrical substrate 110 with one or more functional layers 120 and/or 130 formed thereon. In various embodiments, the cylindrical substrate 110 can take the form of a cylindrical tube, e.g., having a hollow structure including a heating lamp therein, or a solid cylindrical shaft in FIG. 2, the exemplary fixing member 200 can include a belt substrate 210 with one or more functional layers, e.g., 220 and/or 230 formed thereon. The belt substrate 210 and the cylindrical substrate 110 can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes), metal materials (e.g., aluminum, or stainless steel) to maintain rigidity, structural integrity as known to one of ordinary skill in the art.

As shown in FIGS. 1A-1B and FIG. 2, the outer layers 130 and 230 can be superhydrophobic or superoleophobic as described herein and can have disclosed textured structure on the surface. For example, the outer layers 130 and 230 can have a water contact angle of about 150° or higher.

In an exemplary embodiment as shown in FIG. 1A, the exemplary fuser roll 100A can have an outer layer 130, such as a silicone rubber layer or a fluoroplastic layer having desired surface texture structure (e.g., as shown below in FIGS. 3A-3B) formed on a metal roller as the cylindrical substrate 110. The outer layer 130 can have a thickness of, e.g., about 25 microns to about 5 mm formed on the substrate 110. Such outer layer (see 230 in FIG. 2) can also be formed in a belt configuration, such as, on a belt substrate 210 as shown in FIG. 2.

In another exemplary embodiment as shown in FIG. 1B, the exemplary fuser roll 100B can have one or more layer disposed between the outer layer 130 and the cylindrical substrate 110 shown in FIG. 1A For example, the fuser roll can be in a 2-layer configuration having a compliant layer 120, such as a silicone rubber layer (e.g., about 1 mm to about 5 mm thick), disposed between the outer layer 130, that provides desired surface hydrophobicity or oleophobicity, such as a fluoroplastic layer of about 10 to about 100 microns thick, and the cylindrical substrate 110, such as a metal used in the related art.

Figure 3A:
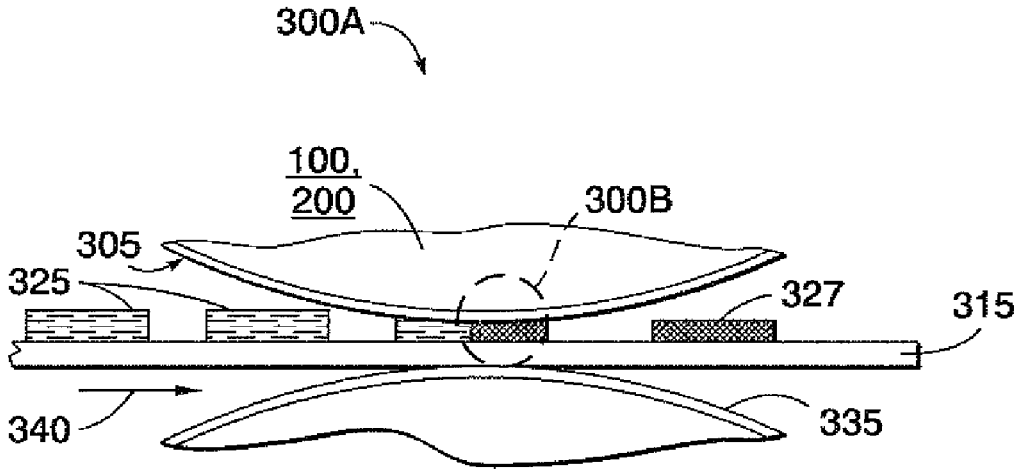
FIG. 3A depicts an exemplary fusing process having the disclosed textured fuser surface shown in FIGS. 1-2 in accordance with the present teachings.
Figure 3B:
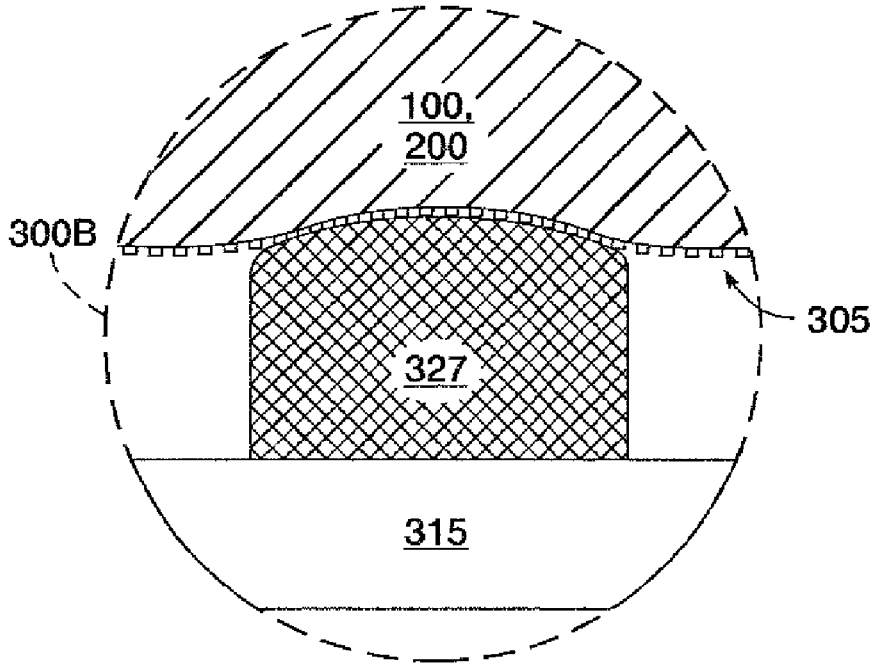
FIG. 3B depicts an enlarged view of a portion of the exemplary fuser nip shown in FIG. 3A in accordance with the present teachings.

In various embodiments, the disclosed hydrophobic/oleophobic textured surface of the fixing members shown in FIGS. 1A-1B and FIG. 2 can be used to enhance the toner releasing ability, as described in FIGS. 3A-3B.

FIG. 3A depicts an exemplary fusing process 300A using the disclosed hydrophobic/oleophobic fuser member 100 or 200 in accordance with the present teachings. As shown, the fusing process 300 can include, for example, a fuser surface 305, i.e., a hydrophobic/oleophobic surface of a fuser member (e.g., the fuser roll 100A-B of FIGS. 1A-1B or the fuser belt 200 of FIG. 2). The fusing process 300 can also include a media substrate 315 as an image supporting material, such as a plain paper sheet, loaded with fusible image toner 325 and passing through a fuser nip 300B between the fuser surface 305 and a second fixing member, such as a pressure applying mechanism 335, e.g., in a direction of 340. After passing through the fuser nip 300B, the fusible toner 325 can be fused to form permanent toner image 327 on the media substrate 315.

FIG. 3B depicts an enlarged view of the fuser nip 300B as shown in FIG. 3A in accordance with the present teachings. The fuser nip 300B can include molten toner 327 fixed between the fuser surface 305 and the media substrate 315. As shown, the fuser surface 305 can have patterned surface structures in micro-or nano-scale to provide surface hydrophobicity or oleophobicity. For example, the surface structure can have a lateral dimension of about 0.05 micron to about 5 microns with a surface area coverage of about 5% to about 40%. In various embodiments, the surface structure can have various lateral or vertical cross sectional shapes, such as, a square, rectangular, circle or star having a height of, e.g., about 0.02 micron to about 4 microns.

Figure 4A:
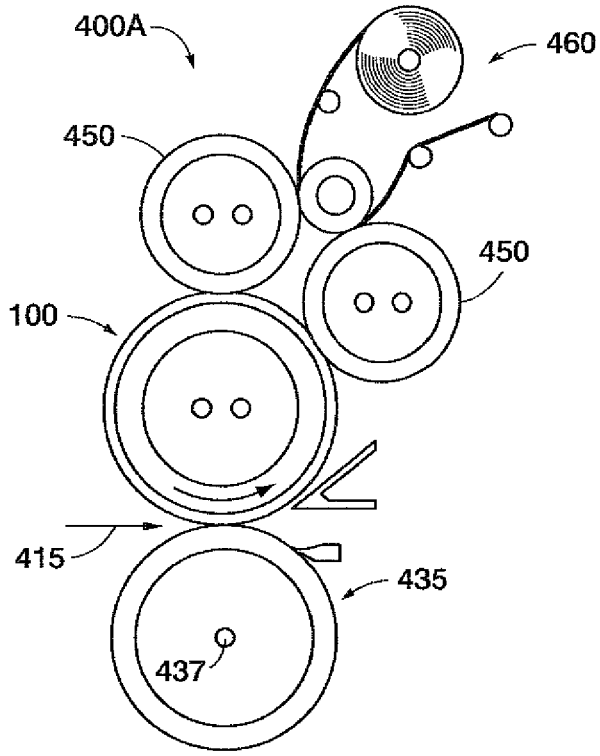
FIGS. 4A-4B depict exemplary fusing configurations using the fuser rolls shown in FIGS. 1A-1B in accordance with the present teachings.
Figure 4B:
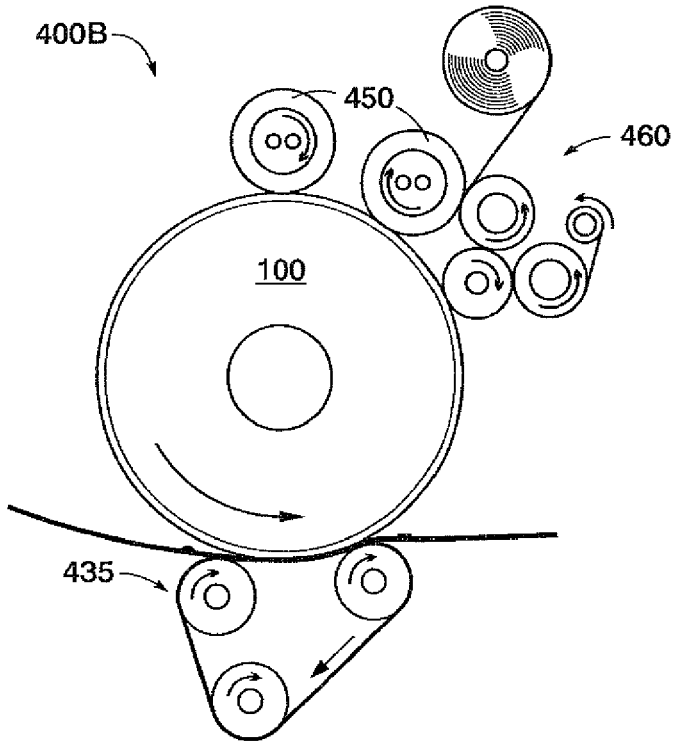
Figure 5A:
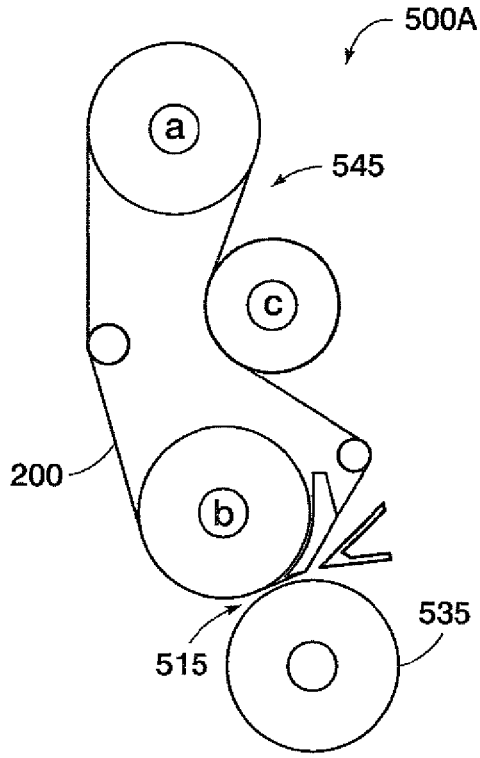
FIGS. 5A-5B depict another exemplary fusing configurations using the fuser belt shown in FIG. 2 in accordance with the present teachings.
Figure 5B:
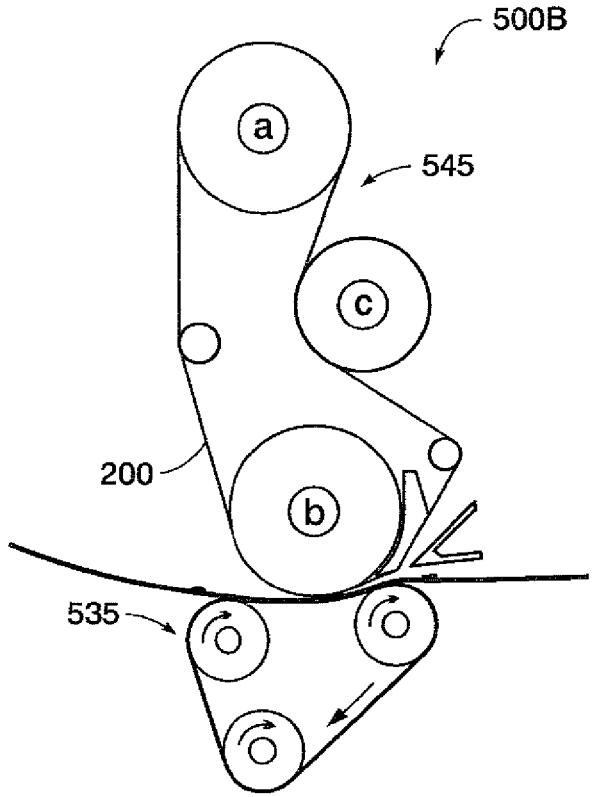

FIGS. 4A-4B and FIGS. 5A-5B depict exemplary fusing configurations for the fusing process as shown in FIGS. 3A-3B in accordance with the present teachings. It should be readily apparent to one of ordinary skill in the art that the fusing configurations 400A-B depicted in FIGS. 4A-4B and the fusing configurations 500A-B depicted in FIGS. 5A-5B represent generalized schematic illustrations and that other members/layers/substrates/configurations can be added or existing members/layers/substrates/configurations can be removed or modified.

FIGS. 4A-4B depict the fusing configurations 400A-B using a fuser roll shown in FIGS. 1A-1B in accordance with the present teachings. The configurations 400A-B can include a fuser roll 100 (i.e., 100A of FIG. 1A or 100B of FIG. 1B) that forms a fuser nip with a pressure applying mechanism 435, such as a pressure roll in FIG. 4A or a pressure belt in FIG. 4B, for an image supporting material 415. In various embodiments, the pressure applying mechanism 435 can be used in a combination with a heat lamp 437 to provide both the pressure and heat for the fusing process of the toner particles on the image supporting material 415. In addition, the configurations 400A-B can include one or more external heat roll 450 along with, e.g., a cleaning web 460, as shown in FIG. 4A and FIG. 4B.

FIGS. 5A-5B depict fusing configurations 500A-B using a fuser belt shown in FIG. 2 in accordance with the present teachings. The configurations 500A-B can include a fuser belt 200 (i.e., 200 of FIG. 2) that forms a fuser nip with a pressure applying mechanism 535, such as a pressure roll in FIG. 5A or a pressure belt in FIG. 5B, for a media substrate 515. In various embodiments, the pressure applying mechanism 535 can be used in a combination with a heat lamp to provide both the pressure and heat for the fusing process of the toner particles on the media substrate 515. In addition, the configurations 500A-B can include a mechanical system 545 to move the fuser belt 200 and thus fusing the toner particles and forming images on the media substrate 515. The mechanical system 545 can include one or more rolls 545*a-c*, which can also be used as heat rolls when needed.

In various embodiments, the fuser surface (e.g., 130 in FIGS. 1A-1B, 230 in FIG. 2, and 305 in FIG. 3A-3B) is appropriately textured, e.g., roughened or patterned in the nano-or micro-or combination of nano-and micro-dimensions, to provide the hydrophobic or oleophobic textured surface for the fusible or molten toner. When molten toner is fused into the media substrate, such as a paper sheet, under pressure and heat, the fuser surface can be released freely at the exit of the fuser nip, since the molten toner can not be able to "wet" the fuser surface due to the surface hydrophobicity or oleophobicity. In various embodiments, when toner with high surface tension in the molten state is used, oil-less fusing can be further enhanced from the hydrophobic textured surface or the textured oleophobic surface.

It should be appreciated that, while the fixing members, configurations, and methods have been described in conjunction with exemplary fusing members, configurations, and methods according to this disclosure are not limited to such applications. For example, the disclosed hydrophobic surface, oleophobic textured surface and configurations can also be used for transfuse members such as rolls and belts or other fixing devices.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fixing member comprising:

a substrate, and one or more functional layers formed on the substrate, wherein the one or more functional layers comprise a textured olephobic outermost surface for providing a surface wettability suitable for an oil-less fixing and wherein the surface wettability comprises a contact angle of about 90 degrees or greater with one or more of hexadecane, hydrocarbon, or silicone oil.

2. The member of claim 1, wherein the textured olephobic outermost surface is further hydrophobic, wherein the surface wettability comprises a water contact angle of about 120 degrees or greater.

3. The member of claim 1, wherein the surface is further ultraoleophobicity or superoleophobicity.

4. The member of claim 1, wherein the textured olephobic outermost surface comprises one or more features having a cross-sectional shape selected from the group consisting of a square, rectangular, circle, triangle, and star.

5. The member of claim 1, wherein the textured olephobic outermost surface comprises a hierarchical surface texture having one or more periodical structures having multiple heights or depths.

6. The member of claim 1, wherein the textured olephobic outermost surface comprises one or more protrusive or intrusive features.

7. The member of claim 1, wherein the textured olephobic outermost surface comprises one or more features, wherein at least 80% of the one or more features have a height or a depth of about 20 nm to about 10 μm.

8. The member of claim 1, wherein the textured olephobic outermost surface comprises one or more features, wherein at least 80% of the one or more features have a mean diameter of about 20 nm to about 10 μm.

9. The member of claim 1, wherein the textured olephobic outermost surface further has a reduced contact surface area to water or hexadecane, wherein the reduced contact surface area is about 1% to about 50% with respect to a contact surface area having a complete touching with water or hexadecane.

10. The member of claim 1, wherein the textured olephobic surface is formed from one or more materials selected from the group consisting of silicone rubbers, copolymers of vinylidenefluoride, hexafluoropropylene and tetrafluoroethylene, terpolymers of vinylidenefluoride, hexafluoropropylene and tetrafluoroethylene, PFA (polyfluoroalkoxypolytetrafluoroethylene), PTFE (polytetrafluoroethylene), FEP (fluorinated ethylenepropylene copolymer), fluoropolyimides and fluoropolyurethanes.

11. The member of claim 1, wherein the substrate has a shape selected from the group consisting of a cylinder, a belt, and a film.

12. The member of claim 1, further comprising a wax-free toner design for an oil-less fusing process suitable for use in an electrostatographic printing process.

13. The member of claim 1, wherein, the substrate comprises a metal roll or a polymer belt, and the textured layer comprises a silicone rubber layer, a fluoroelastomeric layer or a fluoroplastic layer having a thickness of about 20 microns to about 5 mm.

14. A fixing member, comprising:

a substrate comprising a metal cylinder or a polymer belt;

a silicone rubber layer disposed over the substrate, wherein the silicone rubber layer has a thickness of about 1 mm to about 5 mm; and a fluoroplastic layer comprising a textured olephobic outermost surface for providing a surface wettability suitable for oil-less fixing and wherein the surface wettability comprises a contact angle of about 90 degrees or greater with one or more of hexadecane, hydrocarbon, or silicone oil, disposed over the silicone rubber layer, and wherein the fluoroplastic layer has a thickness of about 10 microns to about 50 microns.

15. A method for making a fixing member comprising:

providing a substrate; and forming one or more functional layers on the substrate, wherein the one or more functional layers are formed comprising a textured olephobic outermost surface for providing a surface wettability suitable for oil-less fixing upon an image supporting material and wherein the surface wettability comprises a contact angle of about 90 degrees or greater with one or more of hexadecane, hydrocarbon, or silicone oil.

16. The method of claim 15, further comprising forming the textured olephobic outermost surface having a roughness from a spontaneous process comprising one or more of freezing, deposition, precipitation, and self-aggregation.

17. The method of claim 15, further comprising forming the textured olephobic outermost surface using one or more processes chosen from photolithography, e-beam lithography, soft lithography, or molding process.

18. A method for fixing a toner image comprising:

providing a fusible toner image on an image supporting material;

providing a fixing member comprising a textured olephobic outermost surface having a surface wettability for oil-less toner fixing upon the image supporting material and wherein the surface wettability comprises a contact angle of about 90 degrees or greater with one or more of hexadecane, hydrocarbon, or silicone oil;

applying the fixing member onto the fusible toner image on the image supporting material, wherein a second fixing member comprises a pressure applying mechanism; and applying heat.

19. The method of claim 18, further comprising a wax-free toner design for the oil-less toner fixing upon the image supporting material.

20. The method of claim 19, wherein the oil-less toner fixing further comprises stripping the image supporting material due to the surface wettability.

* * * * *